US011457729B2

(12) United States Patent
White et al.

(10) Patent No.: US 11,457,729 B2
(45) Date of Patent: Oct. 4, 2022

(54) UTILITY TABLE APPARATUS AND METHOD

(71) Applicants: Derek Ryan White, Denham Springs, LA (US); Chris James Latting, Pride, LA (US)

(72) Inventors: Derek Ryan White, Denham Springs, LA (US); Chris James Latting, Pride, LA (US)

( * ) Notice: Subject to any disclaimer, the term of this patent is extended or adjusted under 35 U.S.C. 154(b) by 0 days.

(21) Appl. No.: 16/866,004

(22) Filed: May 4, 2020

(65) Prior Publication Data

US 2020/0345132 A1 Nov. 5, 2020

Related U.S. Application Data

(60) Provisional application No. 62/842,813, filed on May 3, 2019.

(51) Int. Cl.

| | |
|---|---|
| ***A47B 5/00*** | (2006.01) |
| ***A47B 37/04*** | (2006.01) |
| ***B65D 25/20*** | (2006.01) |
| ***A47B 9/20*** | (2006.01) |
| ***A47B 5/04*** | (2006.01) |

(52) U.S. Cl.

CPC ..... *A47B 5/006* (2013.01); *A47B 5/04* (2013.01); *A47B 9/20* (2013.01); *A47B 37/04* (2013.01); *B65D 25/20* (2013.01)

(58) Field of Classification Search

CPC ..... A47B 45/00; A47B 3/0809; A47B 3/091
USPC ..... 108/26, 42, 49, 90, 152, 46, 47; 62/331
See application file for complete search history.

(56) References Cited

U.S. PATENT DOCUMENTS

| | | | | | |
|---|---|---|---|---|---|
| 624,115 | A * | 5/1899 | Steele | A47B 5/04 | 108/134 |
| 1,571,807 | A * | 2/1926 | Schmitt | A47B 3/0916 | 108/132 |
| 1,778,124 | A * | 10/1930 | Sauer | A47B 3/0916 | 108/132 |
| 3,181,483 | A * | 5/1965 | Devitt | A47B 31/06 | 108/25 |
| 3,606,846 | A * | 9/1971 | Andrews et al. | A47B 3/0916 | 108/132 |
| 5,158,023 | A * | 10/1992 | Allen | E04G 5/00 | 108/42 |
| 5,381,738 | A * | 1/1995 | Meyer | A47B 5/00 | 108/108 |
| 5,775,655 | A * | 7/1998 | Schmeets | A47B 5/00 | 108/115 |
| 6,148,737 | A * | 11/2000 | Bowman | A47F 3/142 | 108/42 |
| 6,343,834 | B1 * | 2/2002 | Wurmlinger | A47C 9/06 | 108/134 |

(Continued)

*Primary Examiner* — Jose V Chen
(74) *Attorney, Agent, or Firm* — Roy Kiesel Ford Doody & North, APLC; Chad A. Grand

(57) ABSTRACT

In the specification and drawings a cooler-mounted utility table is described and shown with a work surface; a vertical support member; at least one work surface support rail connected to the work surface and pivotally connected to the vertical support member so that the work surface may pivot from a horizontal position for use and a vertical position for storage and transport; and a mounting bracket configured to securely receive the vertical support member and to be attached to the cooler using the existing structure of the cooler.

14 Claims, 18 Drawing Sheets

(56) References Cited

U.S. PATENT DOCUMENTS

| | | | | | |
|---|---|---|---|---|---|
| D481,266 | S * | 10/2003 | Schilhab | D3/312 | |
| 6,984,066 | B2 * | 1/2006 | Borom | A61B 6/0442 | 108/42 |
| D545,523 | S * | 6/2007 | Goldberg | D34/11 | |
| 7,290,490 | B2 * | 11/2007 | Goldberg | A47B 23/001 | 108/24 |
| 7,322,300 | B2 * | 1/2008 | Caeton | A47B 13/088 | 108/50.12 |
| 7,658,153 | B1 * | 2/2010 | Patoka | B60R 11/00 | 108/44 |
| 8,079,312 | B2 * | 12/2011 | Long | B60N 3/005 | 108/44 |
| 8,356,712 | B2 | 1/2013 | Piazza, Jr. | | |
| 8,857,347 | B1 * | 10/2014 | Liu | A47B 5/02 | 108/47 |
| 9,259,090 | B1 * | 2/2016 | Cronin | A47C 7/54 | |
| 10,499,744 | B2 * | 12/2019 | Becker | F25D 3/08 | |

* cited by examiner

UTILITY TABLE APPARATUS AND METHOD

This application claims the benefit of U.S. Provisional Application No. 62/842,813, filed May 3, 2019, which is hereby incorporated by reference in its entirety.

BACKGROUND

Ice chests or coolers have been around for decades. In about 2006, a new type of cooler was introduced to the market: the roto-molded cooler. Yeti is a leading brand of roto-molded coolers and it was the first, or one of the first, to popularize this new design. These coolers are much more durable and have substantially improved insulation, when compared to older, traditional ice chests or coolers. The new roto-molded coolers are considerably more expensive than traditional coolers, and purchasers of these new products often look for ways to maximize their use and enjoyment of these coolers.

Roto-molded coolers, and more rugged models of traditional design, are often used in many recreational activities and outdoor activities, including fishing, boating, camping, cookouts, tailgating, beach activities, and other activities. In many boats, such as pleasure and fishing boats, a cooler is secured to the boat using brackets and/or tie-down straps. Some coolers used in boats have cushioned tops that serve as both coolers and seats for persons in the boat. Some boat owners use the hard top of a cooler as a table surface, to perform a variety of tasks. Anglers, for example, may prepare bait on the top of the cooler. Others may place drink cans on the top of the cooler or other items. This use of the cooler is quite common, but it has significant drawbacks. Perhaps most importantly, the cooler top is typically quite low, near the knees of an adult. That does not make for a very user-friendly table surface, regardless of what action the user is performing. Some action may damage the cooler top, such as cutting bait for fishing.

There is a need for a better working surface connected to or made as a part of coolers. This need may be more acute for owners of high-end roto-molded coolers, in part because such owners have spent hundreds of dollars to buy the cooler and want to get the most out of it. There are too many problems associated with use of the cooler top as a work surface.

SUMMARY OF THE INVENTION

The present invention is a utility table that attaches directly to a cooler. The invention is intended primarily for the newer roto-molded coolers, but it will work with almost any cooler that is strong enough to support the added structure of the invention. Many traditionally-designed coolers, including many marine-grade coolers, will be heavy and strong enough to support use of the invention. So although the invention arose from a desire to fill a need related to roto-molded coolers, the invention is not limited to such coolers.

The invention provides a table working surface sized to meet a user's needs. Different table surface sizes may be used with different sizes of coolers or situations. For a large cooler used on a fishing boat, a large table surface may be appropriate. The invention secures the table working surface to a support structure that is attached to the cooler. In some embodiments, the size of the table surface, support structure, and/or other structures can be adjustable to accommodate different size coolers or situations. The structure for attaching the table to the cooler is designed for ease of installation, ease of removal, and all without damaging or altering the cooler in any way.

In addition, the support structure of the invention allows for the table surface to be folded down against the support structure, which results in a compact design for storage or transport. For example, the stowed table may be not more than a couple of inches thick and may be stored conveniently out of the way until it is needed. In a fishing boat, the user may store the invention in a suitable place while the anglers are traveling to a fishing location and then attach the invention to the cooler for use while fishing. The table of the present invention could then be removed and stowed prior to the trip home.

In some embodiments, the support structure and all metal parts (e.g., screws) are made of a high-grade stainless steel to prevent corrosion. This aspect of the invention can be particularly important for embodiments of the invention intended for use in saltwater fishing. Saltwater is highly corrosive, and the present invention should be made in a manner that allows for a long period of use without significant corrosion.

The table surface may be made of a variety of materials, such as a strong, durable and easy-to-clean material. A marine-grade plastic, such as a polyethylene material, may work well for the present invention. The table surface should be durable enough to withstand cutting and other potentially damaging actions. In addition, the present invention is made to allow for replacement of the table surface in the event the surface becomes damaged, stained, or for any other reason the owner may want to replace it. Finally, table surfaces in a variety of colors may be used, which allows a user to select a color of choice, perhaps to match the color of the cooler.

DETAILED DESCRIPTION OF EMBODIMENTS OF THE INVENTION

Figure 1:
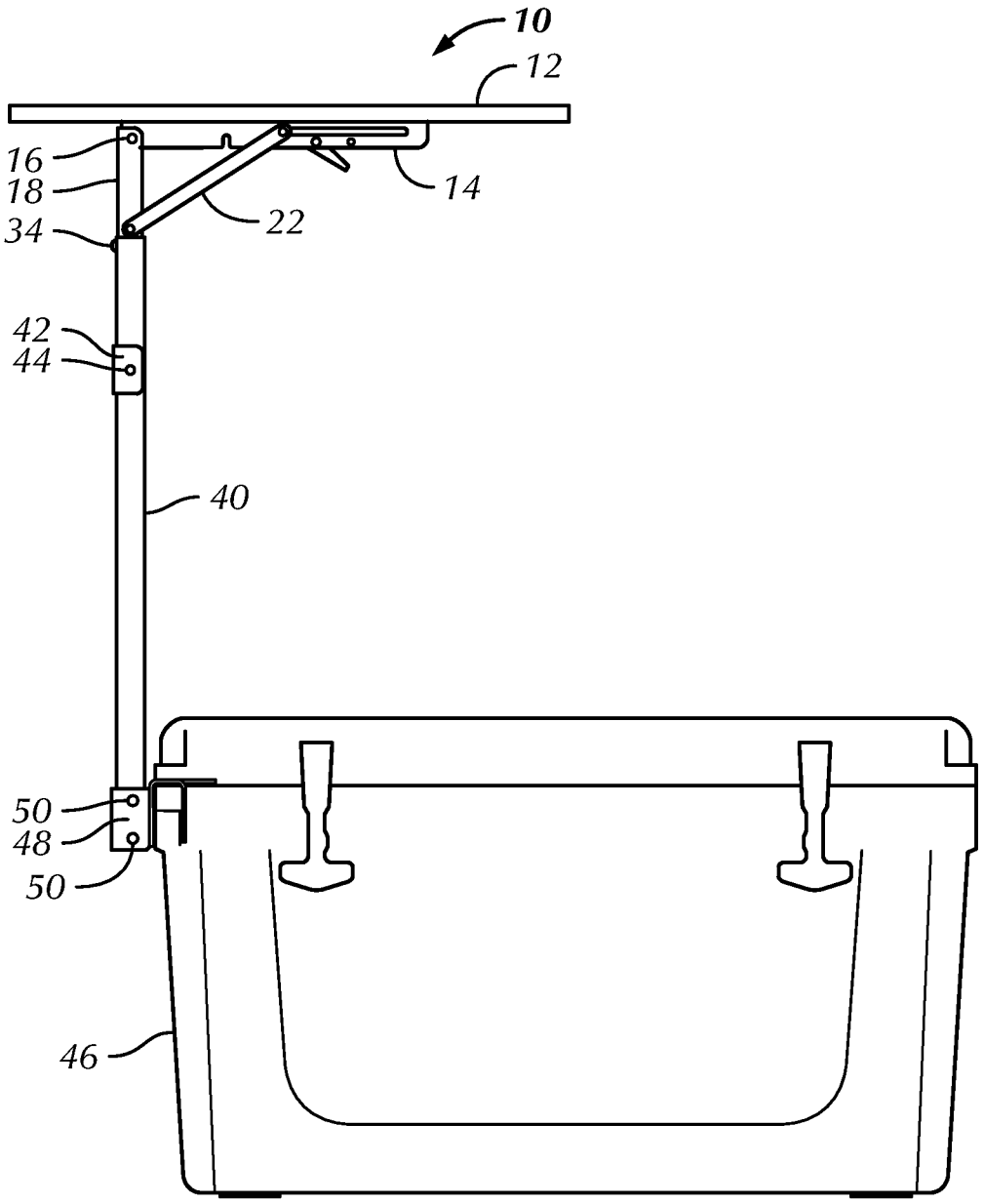
FIG. 1 is a side view of an embodiment of the present invention.

As required, detailed embodiments of the present invention are disclosed herein. However, it is to be understood that the disclosed embodiments are merely exemplary of the invention, which can be embodied in various forms. As such, any feature(s) used in one embodiment can be used in another embodiment. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

Alternate embodiments may be devised without departing from the spirit or the scope of the invention. Additionally, well-known elements of exemplary embodiments of the invention will not be described in detail or will be omitted so as not to obscure the relevant details of the invention.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The terms "connected" and/or "coupled," as used herein, are defined as connected, although not necessarily directly, and not necessarily mechanically.

Relational terms such as first and second, top and bottom, and the like may be used solely to distinguish one entity or action from another entity or action without necessarily requiring or implying any actual such relationship or order between such entities or actions. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Herein various embodiments of the present invention are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Described now are exemplary embodiments of the present invention. FIG. 1 shows an embodiment of a utility table 10 secured to a cooler 46. There is a table work surface 12 which is the primary working area provided by the invention. This work surface 12 is preferably made of a durable material like polyethylene or nylon, but any suitable material may be used. Wood, metal, plastic, or composite material may be used for the work surface 12, which is connected to the work surface support rails 14. The work surface 12 is mounted to the support rails 14 in a permanent or semi-permanent manner (e.g., with metal or wood screws 20—not shown in FIG. 1).

The work surface support rails 14 are connected to an upper vertical support rail 18 by a work surface support rail pivot pin 16. This configuration allows the work surface 12 to be raised (i.e., horizontal position) and lowered to a vertical position. A pivoting support rail 22 is used in this embodiment to provide adequate support to the table work surface 12. This upper part of the structure is physically separate from the lower structural components in this embodiment, which allows a user to easily break down the parts of the invention for storage or transport.

Figure 3:
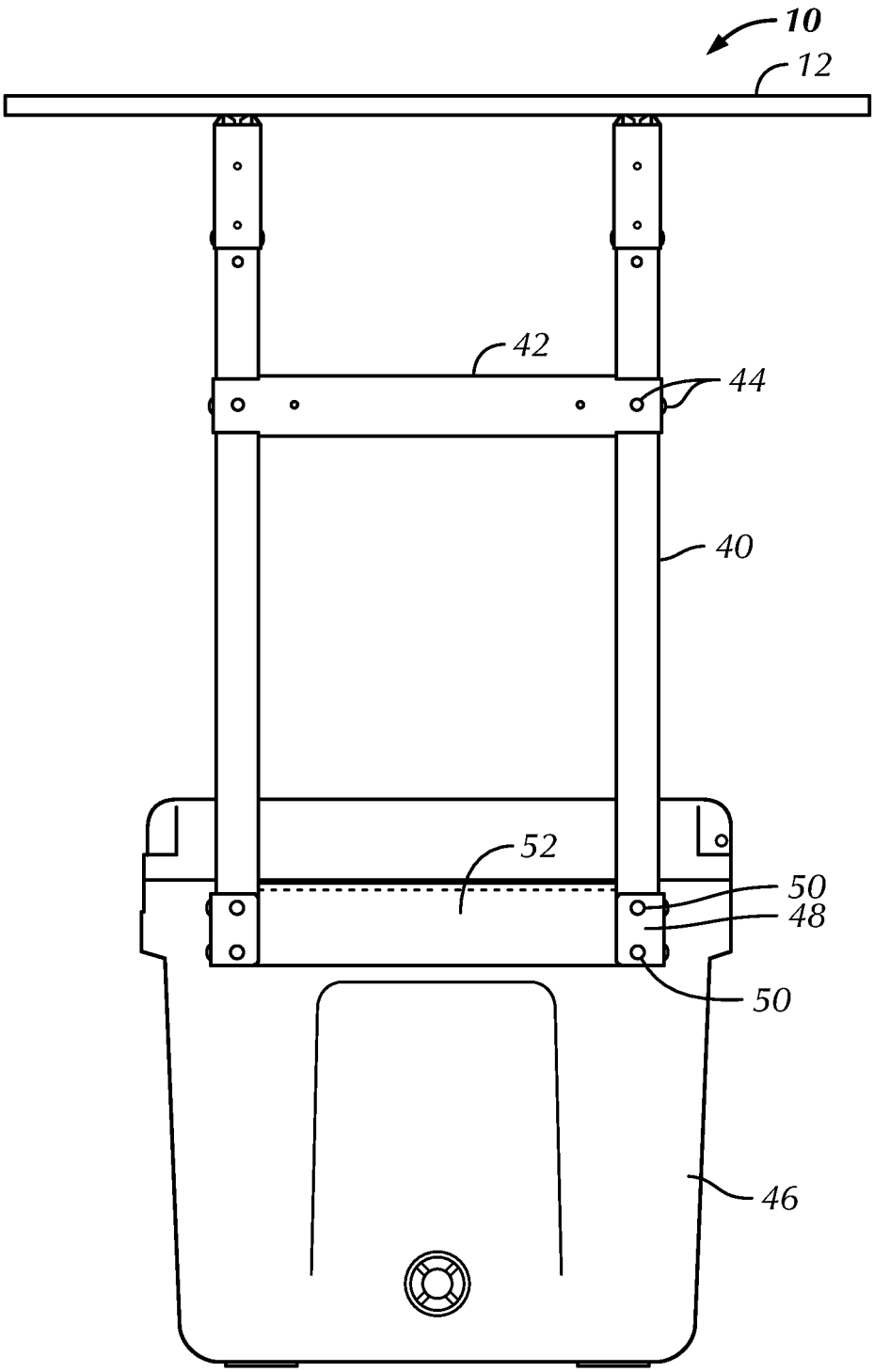
FIG. 3 is an alternative side view of an embodiment of the invention, showing the support structure.

The main vertical support rail 40 is a key part of the lower structure of this embodiment of the invention. In an embodiment, there are two of these vertical support rails 40, as seen in FIG. 3, which is the same embodiment shown in FIG. 1. The upper components, described in the preceding paragraphs mount into these vertical support rails 40, and may use a spring-loaded locking pin 34 to secure the upper components to the vertical support rails 40. Alternative means of securing these parts of the invention may be used, like quick disconnects, latches, or any other well-known structure used to temporarily secure two structures together.

Such securing means can ensure the upper components do not come free from the vertical support rails 40 during operation, for example, on a boat being bounced around by rough seas. The two vertical support rails 40—in the embodiment shown in FIG. 1 and FIG. 3—may be connected together using a cross support 42 and cross support bolts 44.

The vertical rails 40 are secured to the mounting bracket receiver 48 using bracket bolts 50, and the mounting bracket is secured to the cooler 46. The details of the mounting structure are described in more detail below.

Figure 2A:
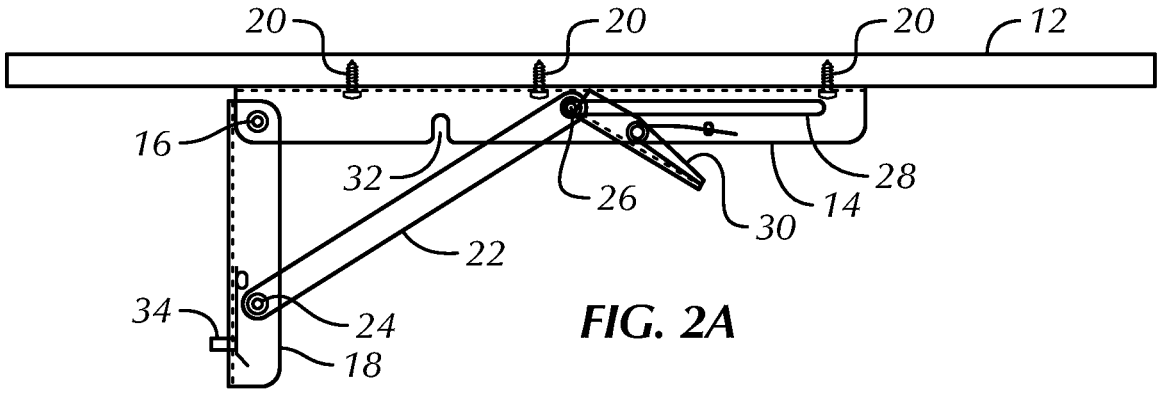
FIG. 2A is a side view of the upper work surface and connected structure of an embodiment of the present invention.
Figure 2B:
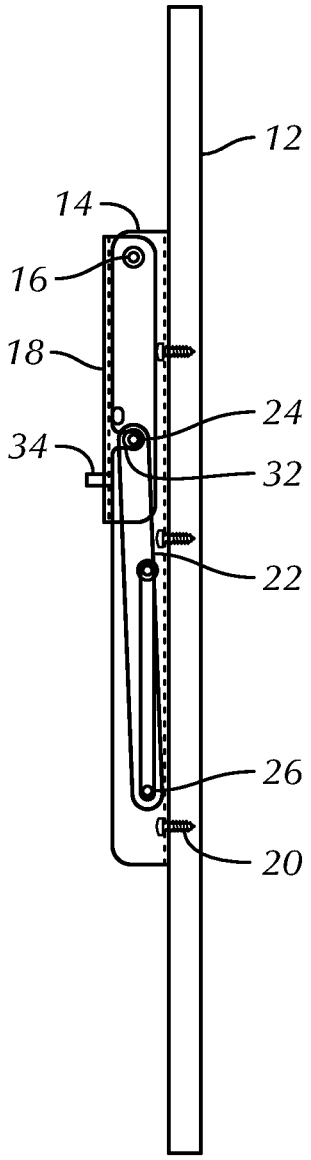
FIG. 2B is a side view of an embodiment of the invention in a compact, stowed position.

FIGS. 2A and 2B show the upper components of the invention in more detail, with these parts shown in operating position in FIG. 2A and in stowed position in FIG. 2B. These two alternate views provide a good illustration of how the key parts of the upper components work together. FIG. 2A shows the table work surface 12 attached to the surface support rails 14 using screws 20. The work surface support rails 14 (in the embodiment shown in FIGS. 1, 2A, 2B, and 3, there are two such rails, one on each side of the work support surface 12) has a slot 28. One end of the pivoting support rail 22 fits into this slot 28 via a rail pivot pin 26. This allows the pivoting support rail 22 to slide in the slot 28, which allows the upper work surface 12 to be pivoted from horizontal position (i.e., in use) to vertical position (storage and transport). The opposite end of the pivoting support rail 22 is connected to the upper vertical rail 18 via a vertical rail pivot pin 24. The pivot pins at each end of this support rod and the slot 28 in the work surface support rails 14 allow the approximately 90 degree rotation of the work surface 12 shown in FIGS. 2A and 2B.

These figures also show a spring-loaded latching lever 30, which is used to lock the work surface 12 into the horizontal position for use as a utility table surface. The spring loading ensures the upper end of the pivoting support rail 22 is locked into place at the end of the slot 28 farthest from the upper vertical rail 18. A notch 32 is shown to receive the upper vertical rail pivoting pin 24 when the work surface 12 is in the stored position—this is shown in FIG. 2B where the notch 32 is shown positioned over the pivoting pin 24. This notch 32 allows the work surface rails 14 to essentially nest in the upper vertical support rails 18, allowing for a more compact assembly for storage and transport. The spring-loaded locking pin 34 is shown in more detail in FIG. 2A, which shows a commonly-used type of spring tab.

FIG. 3 shows the same embodiment of the cooler utility table 10, but from an end view. This view shows that use of twin main vertical support rails 40, and the twin work surface support rails 14 can be partially seen. These rails 14 are directly behind, and thus partially blocked from view by, the upper vertical support rails 18. A cross support 42 is used to provide more stability and structural support to the invention. Cross support bolts 44 are used to secure the cross support 42 to the main vertical support rails 40.

The utility table 10 is secured to the cooler 46 via a mounting bracket receiver 48 that is connected to each lower end of the main vertical support rails 40 using mounting bracket receiver bolts 50. The portion of the mounting bracket 60 that extends between the receivers 48 is identified as the mounting bracket vertical support member 52, which is positioned along an outer edge of the cooler 46.

Figure 4:
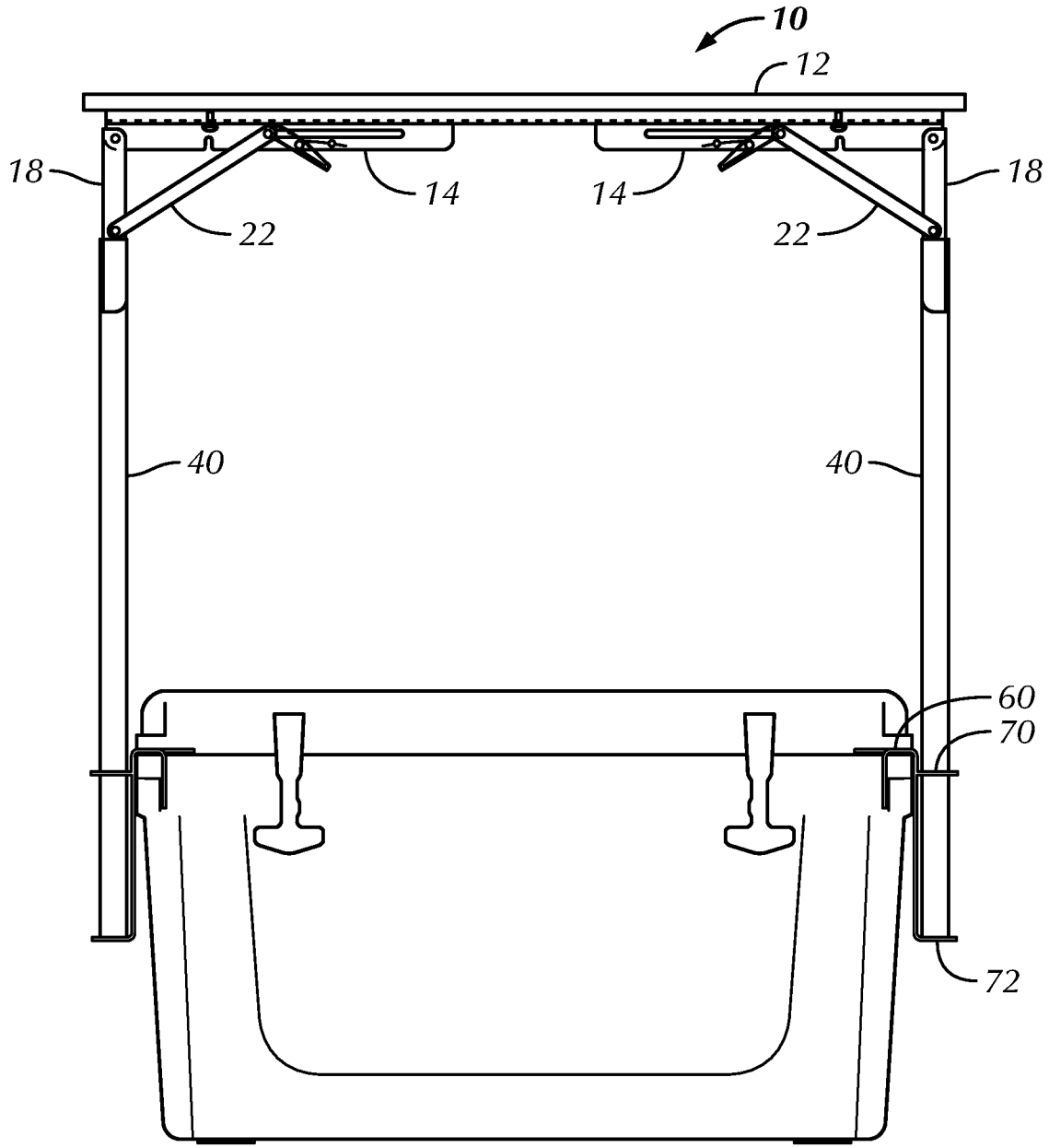
FIG. 4 is a side view of an embodiment of the invention having an extended work surface and support structure on both ends of the work surface.
Figure 5:
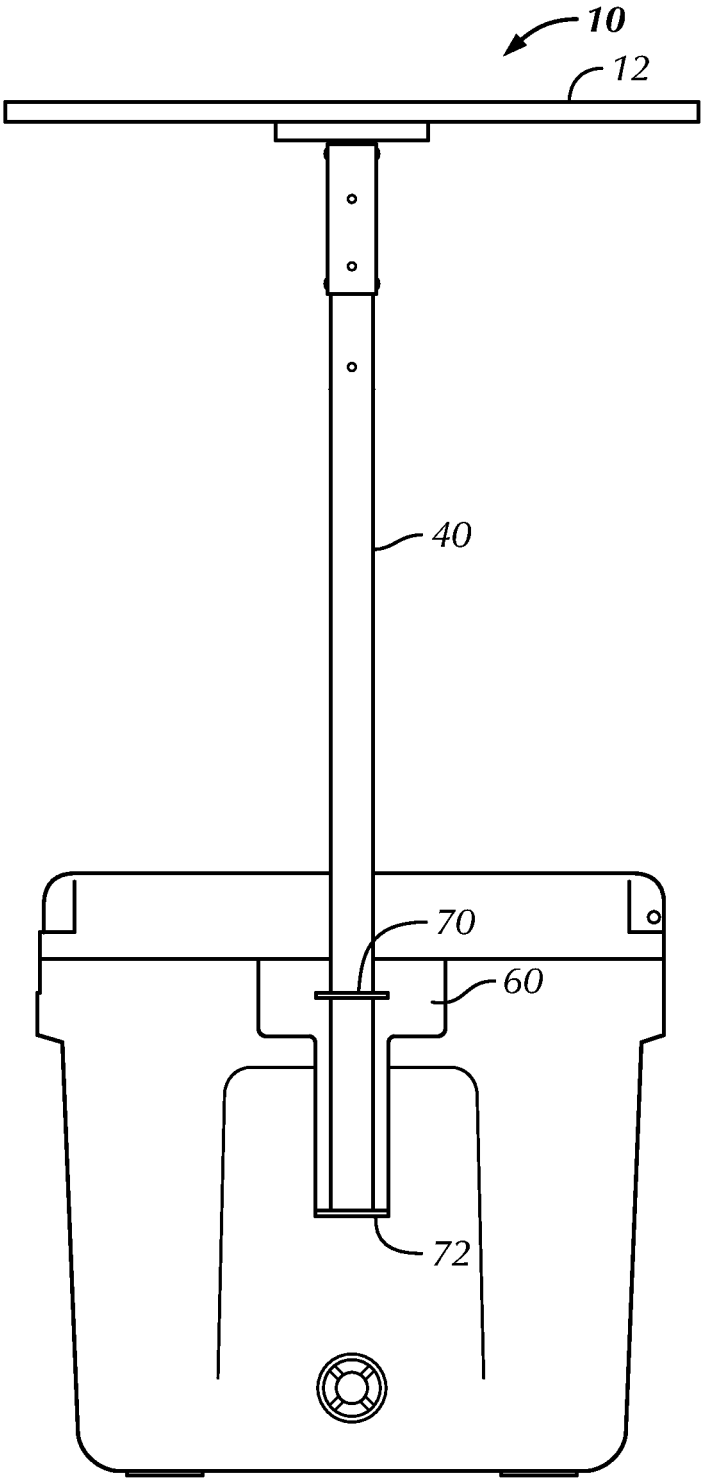
FIG. 5 is a side view of an embodiment of the invention showing an alternative support structure.

FIGS. 4 and 5 show an alternative embodiment of the cooler utility table 10. In this embodiment, a large upper work surface 12 extends the entire length of the cooler 46. The upper components described above are used in this embodiment, too, but with a change. Only a single set of the support rails is used and this assembly is mounted to the center of the work surface 12, as seen in FIG. 5. The side view in FIG. 4 does not reveal this aspect of the embodiment. There are two sets of support rails, one at each end of the table 10, so that the main vertical support rails 40 are secured to both sides of the cooler 46. On each end of the cooler 46, however, there is only one main vertical support rail 40, as contrasted to the twin rails shown in FIG. 3.

This alternative embodiment also uses a different configuration to secure the main vertical support rails 40 to the mounting bracket 60. In this embodiment, the vertical support rails 40 slide through an upper receiver guide 70 and rest against a lower retainer 72. This configuration allows for easy assembly and disassembly of the invention. If a more secure mounting is desired, a securing set screw may be added to the upper receiver guide 70, such that this screw may be tightened against the vertical support rail 40 once that rail is in place. Other means of securing the vertical support rails 40 into the receiving guide 70 and retainer 72 may be used. For example, a clip that goes securely around the rails 40 may be attached to the rails just below (and also above for even more security) the receiver guide 70 once the rails 40 are in place.

Variations of these embodiments are possible and are considered part of the invention. For example, the structure for connecting the vertical rails 40 to the mounting bracket 60 shown in FIGS. 4 and 5 may be used with the embodiment shown in FIGS. 1-3 by providing a pair of receiver guides 70 and lower retainers 72 at each end of the mounting bracket vertical support member 52 shown in FIG. 3. Indeed, a pair of twin, parallel vertical rails 40, like those shown in FIG. 3, could be combined with the single upper component configuration shown in FIGS. 4 and 5. This would require use of a center vertical rail at the upper end of the main vertical rail assembly, and such component could be mounted to the center of the cross support 42. These combinations are not necessarily preferred, but they show the various configurations that are all within the scope of the invention.

The single vertical rails and upper support rails shown in FIGS. 4 and 5 provide less stability for rotational or torsional stresses. That is, the work surface 12 may be more inclined to move slightly around its longitudinal axis. But the use of support structures on each end of the elongated work surface 12 tends to offset this result. Note that it is also possible to use the dual vertical side support rails 40 (as shown in FIG. 3) with the elongated work surface 12 shown in FIG. 4. That is, on each end of the table, there could be a pair of vertical support rails just like those shown in FIG. 3, but with two sets, one on end side of the cooler. This would provide maximum stability and may be desirable in some settings, like use on salt water fishing boats. All of these variations are within the scope of the invention.

FIGS. 6A, 6B, 6C, and 6E show the mounting bracket 60 in more detail. In some embodiments, this bracket is a key part of the invention because it allows for the utility table 10 to be easily, but securely attached to a typical roto-molded cooler without requiring any modification to the cooler. These coolers typically have a tie-down slot 66 as shown in FIG. 6D. This slot 66 allows use of tie down straps to hold the cooler in place, either for transport or during use. In transport, a single strap might be used, but in use, either separate straps or a single strap that extends under the cooler is often preferred in order to prevent the strap from holding the cooler lid shut. The mounting bracket of the present invention has a tab 64 that is configured to fit into the cooler tie down slot 66 in a manner that secures the utility table 10 to the cooler 46, while still allowing use of at least some tie down straps.

Figure 6A:
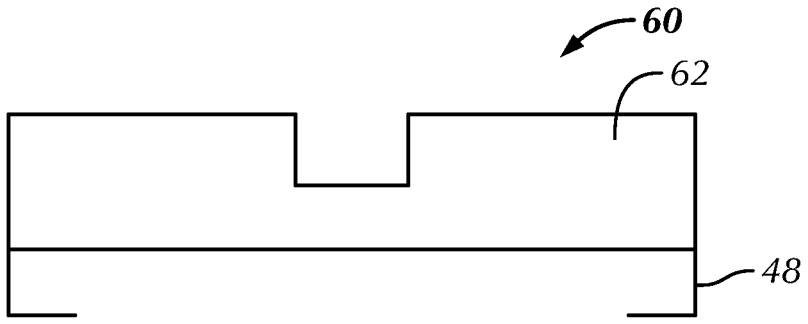
FIG. 6A is a top view of a mounting bracket for the invention.
Figure 6B:
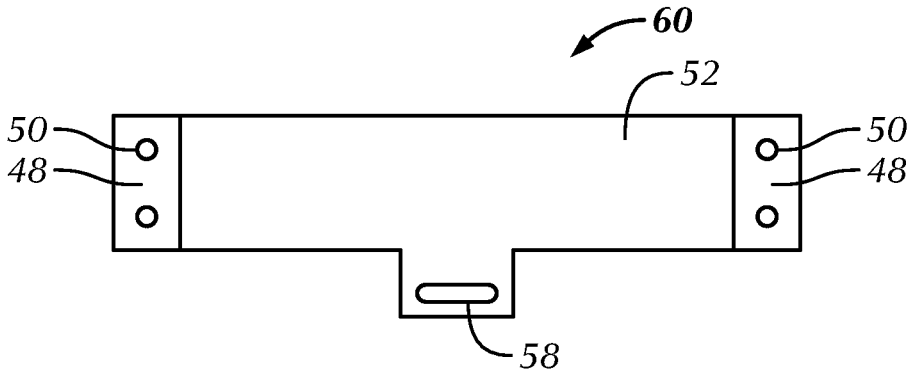
FIG. 6B is an end view of the mounting bracket shown in FIG. 6A.

FIG. 6A is a top view of an embodiment of the mounting bracket 60 and shows the bracket's horizontal support member 62. In use, this member 62 rests on top of an outer edge of the cooler and supports the weight of the utility table 10. A side view of the bracket 60 is shown in FIG. 6B, which presents the same parts of the bracket visible in FIG. 3, namely the vertical support member 52 and the receivers 48 located at each end. The vertical support member 52 rests against an outer side of the cooler 46 in use. This figure also shows mounting bracket receiver bolts 50, though such bolts would actually be used to secure the main vertical support rails 40 (not shown in this figure, but shown in FIG. 3) to the mounting bracket 60. A tie down slot 58 is also shown in FIG. 6B, and this allows a tie down strap to pass through the cooler tie down slot 66 and also through the mounting bracket 60, which tends to provide a more secure connection between the utility table 10 and the cooler 46.

Figure 6C:
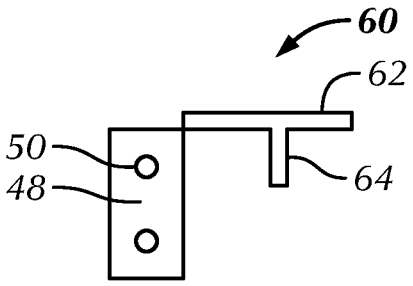
FIG. 6C is a side view of the mounting bracket shown in FIG. 6A.
Figure 6D:
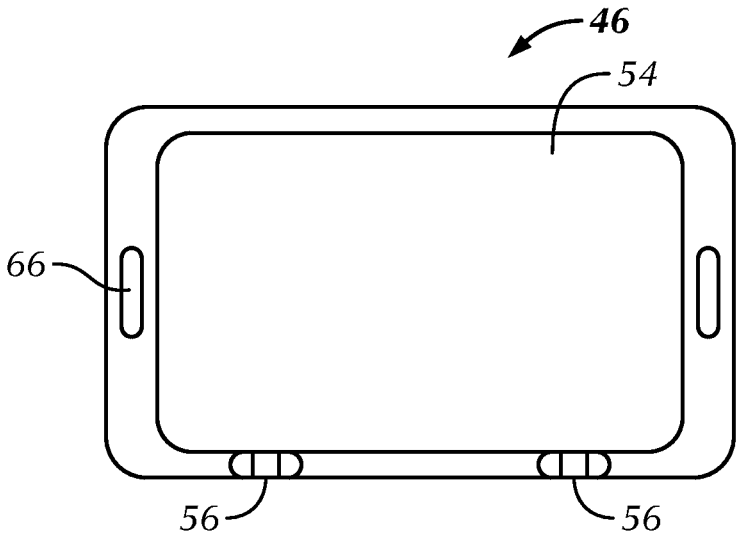
FIG. 6D is a top view of the upper surface of a typical cooler that may be used with the present invention.
Figure 6E:
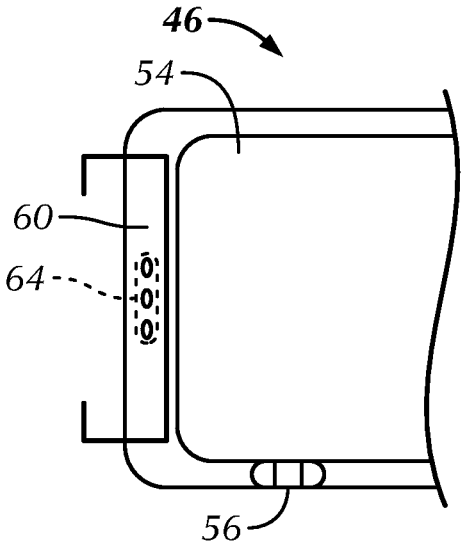
FIG. 6E is a top view showing the mounting bracket attached to a cooler.

FIG. 6C is a side view of the mounting bracket 60, showing one of the receivers 48, the horizontal support member 62, and the tab 64. In some embodiments, the tab 64 can be a key component, because this tab is what slips into the tie-down slot 66 in the cooler 46. As shown in FIG. 6C, the tab 64 extends downward from the vertical support surface. In FIG. 6E, the mounting bracket 60 is shown installed on a cooler 46. The horizontal support member 62 is shown resting on top of an outer edge of the top of the cooler 46. The mounting bracket tab 64 is shown in dashed lines because it is not directly visible in this figure. It is illustrated with dashed lines to make clear where it is located on the bracket 60. The cooler hinges 56 and lid 54 are also shown in FIGS. 6D and 6E.

Figure 7A:
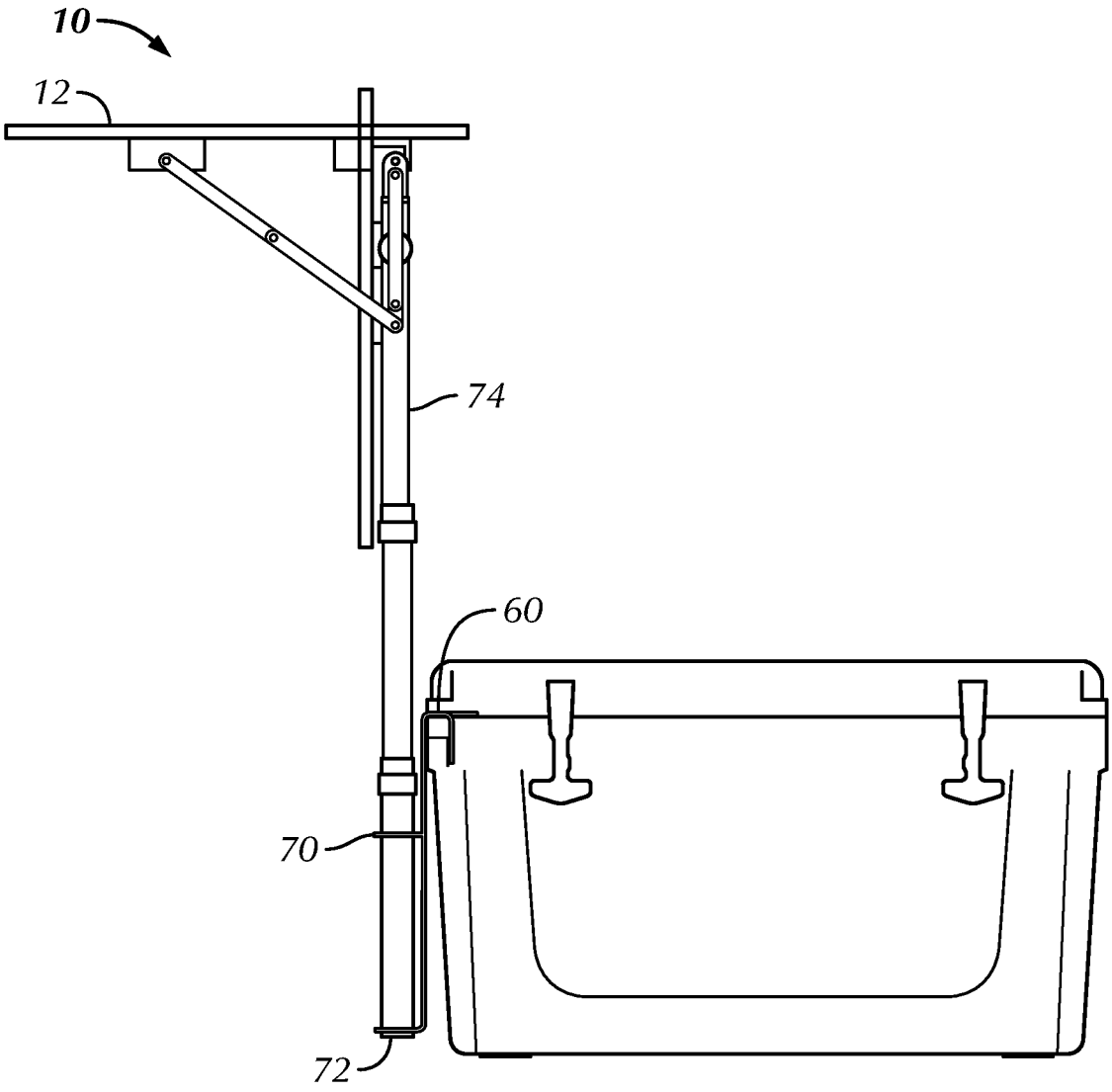
FIG. 7A is a side view of an embodiment of the present invention with a working surface positioned away from the body of the cooler.
Figure 7B:
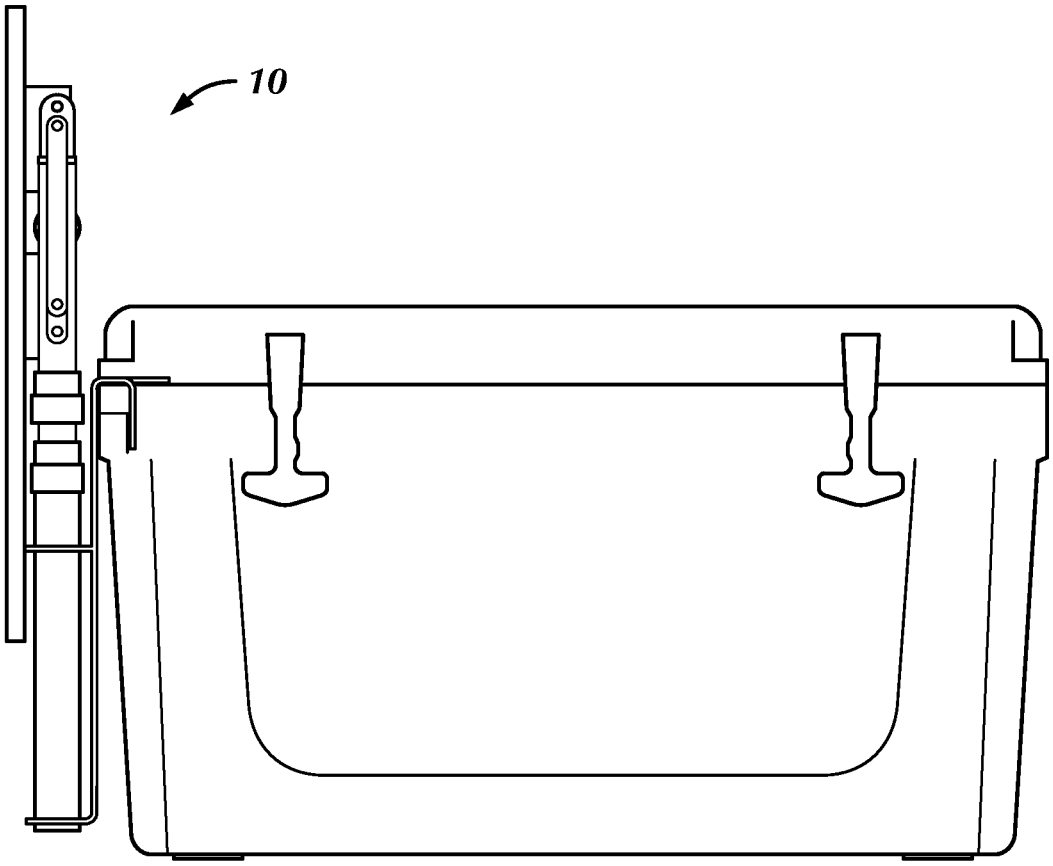
FIG. 7B is a side view of the embodiment shown in FIG. 7A in a compact, stowed position.

FIGS. 7A and 7B show another embodiment, this one using telescoping vertical support rails 74. Such rails are also used in the embodiment shown in FIGS. 8A and 8B, but for a different reason. In the embodiment illustrated by FIGS. 7A and 7B, the utility table 10 has the same type work surface 12 described with the first embodiment described above (i.e., see description of FIGS. 1-3). This surface 12 has a two-part pivoting support member, which is an alternative to the prior configuration that used a single pivoting support member mounting in a slot to allow sliding movement. With the two-part member, the two pieces pivot about each other as the table is lowered from horizontal to vertical position. Both of these positions are shown superimposed over each other in FIG. 7A, in order to conveniently illustrate both the in-use position and the stowed position. In FIG. 7B, the work surface 12 is in the vertical, stowed position, and the telescoping vertical support rails 74 are shortened to allow the utility table 10 to remain attached to the cooler without taking up excess space.

Figure 8A:
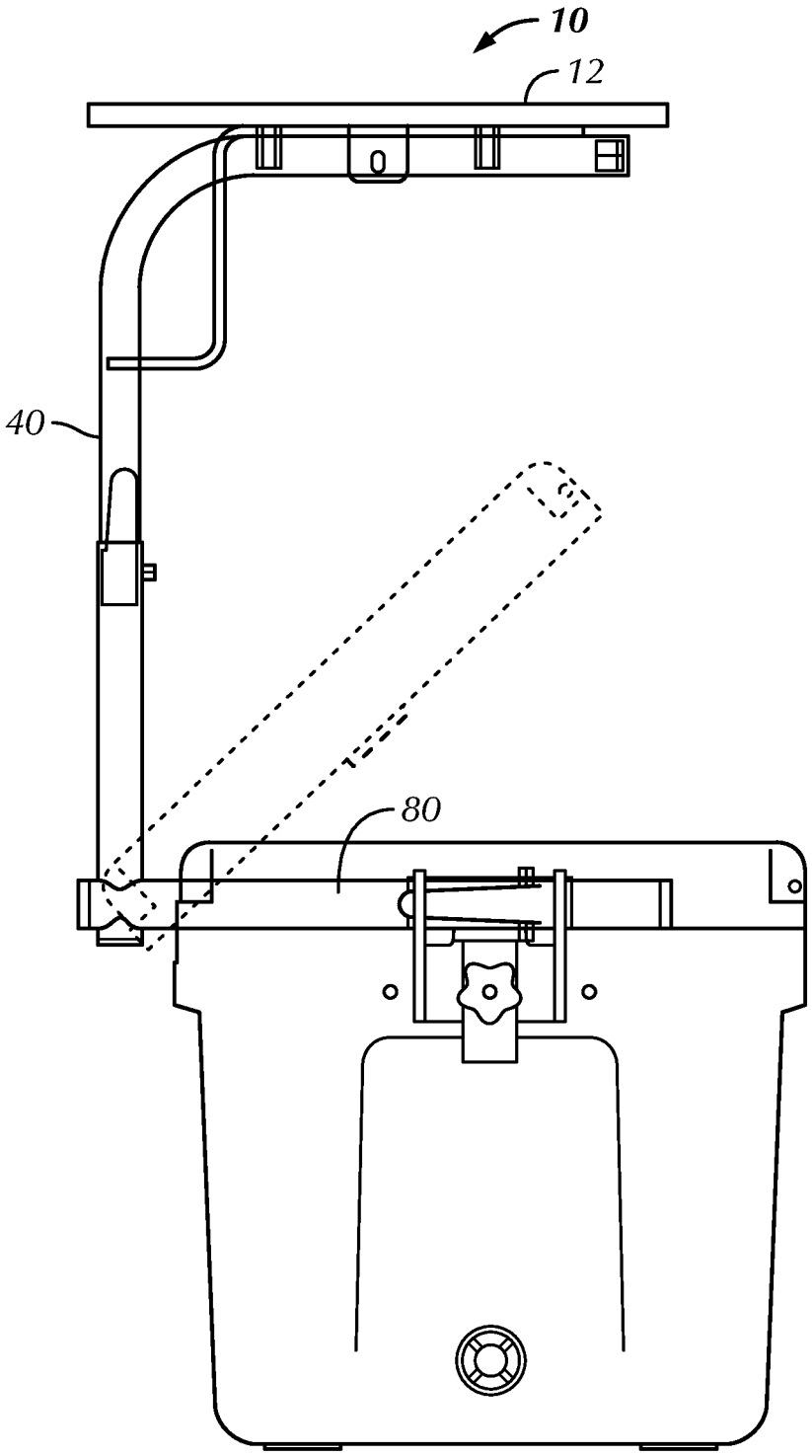
FIG. 8A is an end view of an alternative embodiment of the invention with a support structure that facilitates the opening and closing of the lid of the cooler.
Figure 8B:
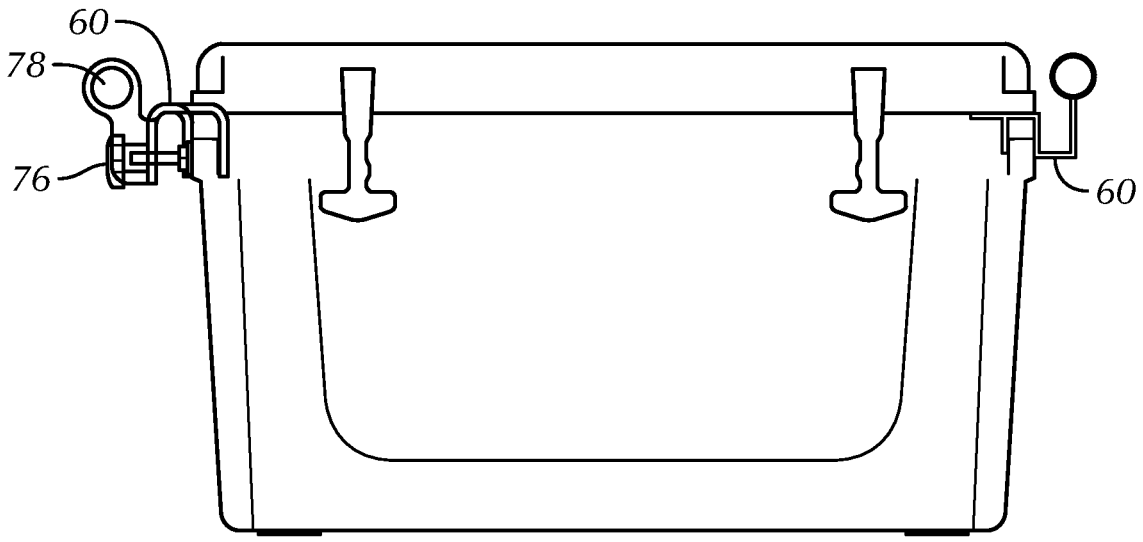
FIG. 8B is a side view of the embodiment shown in FIG. 8A, showing mounting brackets on both ends of the cooler.

The embodiment shown in FIGS. 7A and 7B uses a mounting bracket 60 of the same type disclosed in FIGS. 4-5, which shows yet another example of the various configurations possible with the present invention. A different clamping configuration is shown in FIGS. 8A and 8B. This mounting bracket slips over the edge of the side of the cooler and is then secured with a tightening screw 76. In this embodiment, a lower horizontal support rail 80 is used and that rail is inserted into a horizontal receiver guide 78, which may also have a set screw or other structure to secured the support rail 80 into the receiver guide 78.

The embodiment shown in FIGS. 8A and 8B is configured to allow increased access to and freedom of movement of the lid of the cooler 46. Though the cooler lid may be opened and shut with most of the other embodiments described above, there is structure just to the side of the lid, and this structure may be somewhat restrictive in certain settings. Users who want greater access to the cooler, may prefer the embodiment shown in FIGS. 8A and 8B. By using a lower horizontal support rail 80, this embodiment effectively moves the vertical support rail 40 to the back corner of the cooler, allowing less restricted access to the cooler. This is illustrated, in part, by the dashed line version of the cooler lid, which is presented here simply to show the open position of lid.

Figure 9:
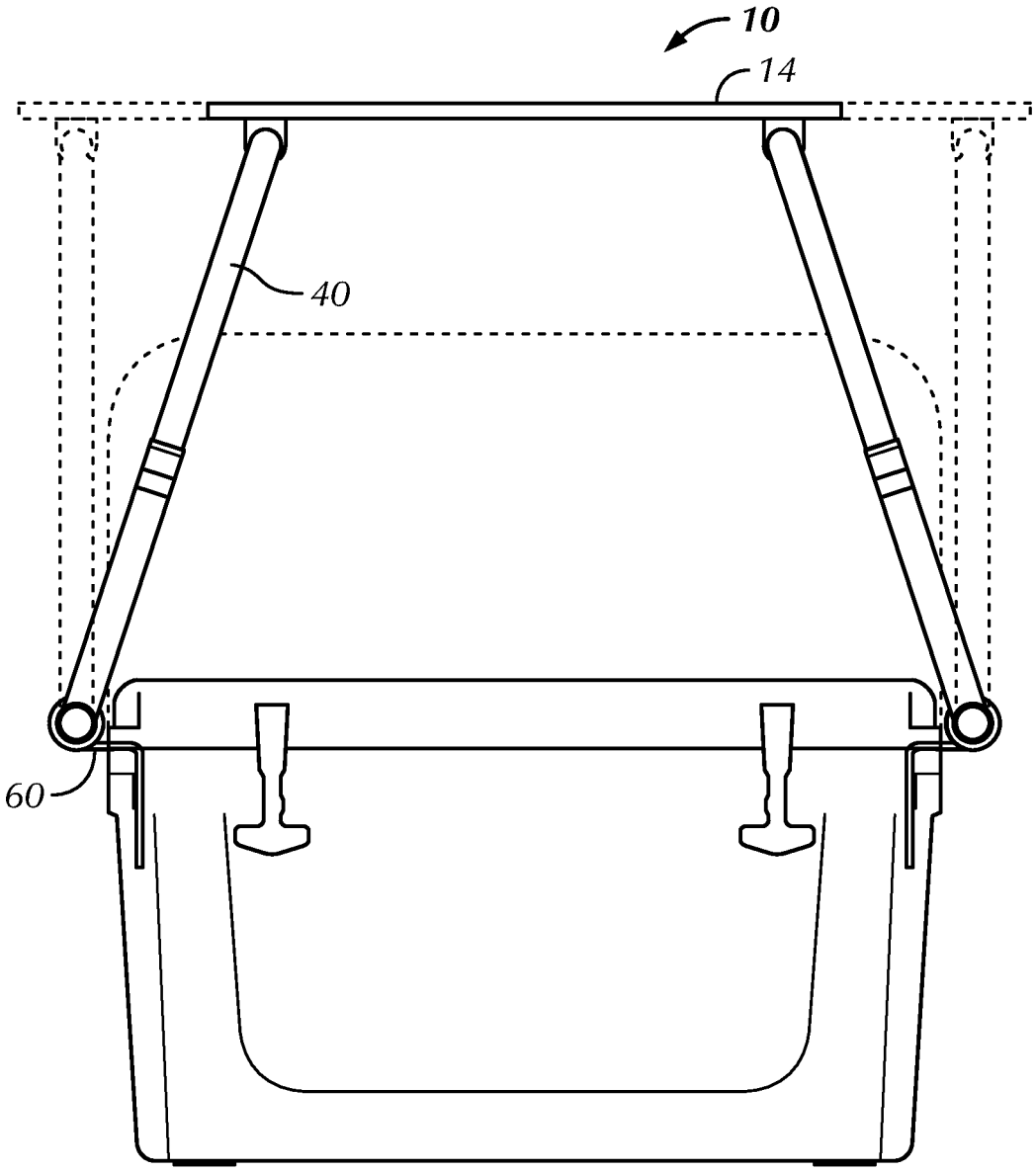
FIG. 9 is a side view of an alternative embodiment of the invention with support structures on both ends of the work surface.

FIG. 9 shows another variation of the invention that uses telescoping support rails 74. In this embodiment, either the work surface 12 or the connections to the work surface are extendable (not directly shown in FIG. 9). For example, the work surface 12 might consist of two parts and a pair of sliding brackets that allow the two parts to be separated, much like the parts of a conventional table with an option leaf to increase its area. In this configuration, the two parts of the work surface 12 are pushed together during use, as shown in the solid lines in FIG. 9. In this position, the telescoping vertical rails 74 are slightly shortened for the fully-extended length and are angled in somewhat from each side of the cooler. This provides a good working arrangement, but it may restrict access to the cooler.

To allow full access to the cooler in this embodiment, the two parts of the work surface 12 are pulled apart, which results in the extension of the telescoping rails 74. This position is shown in dashed lines in FIG. 9. In this position, the side rails do not restrict access to the cooler, and the lid may be opened and closed. This embodiment will work in some settings, because the utility table 10 may not be needed at the same time that access to the cooler is needed.

Figure 12:
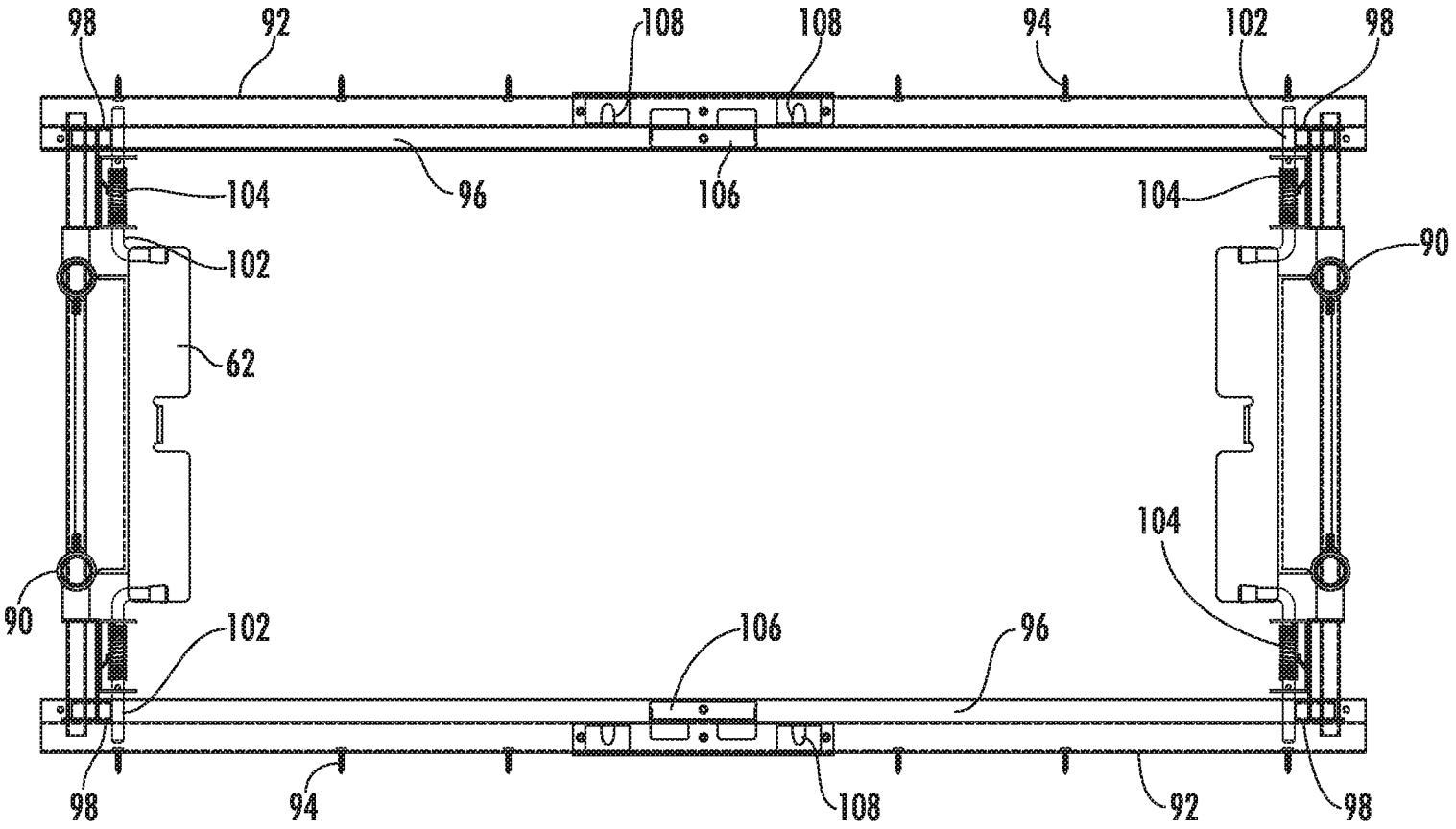
FIG. 12 is a bottom view of an embodiment of the invention in the operating position.
Figure 13:
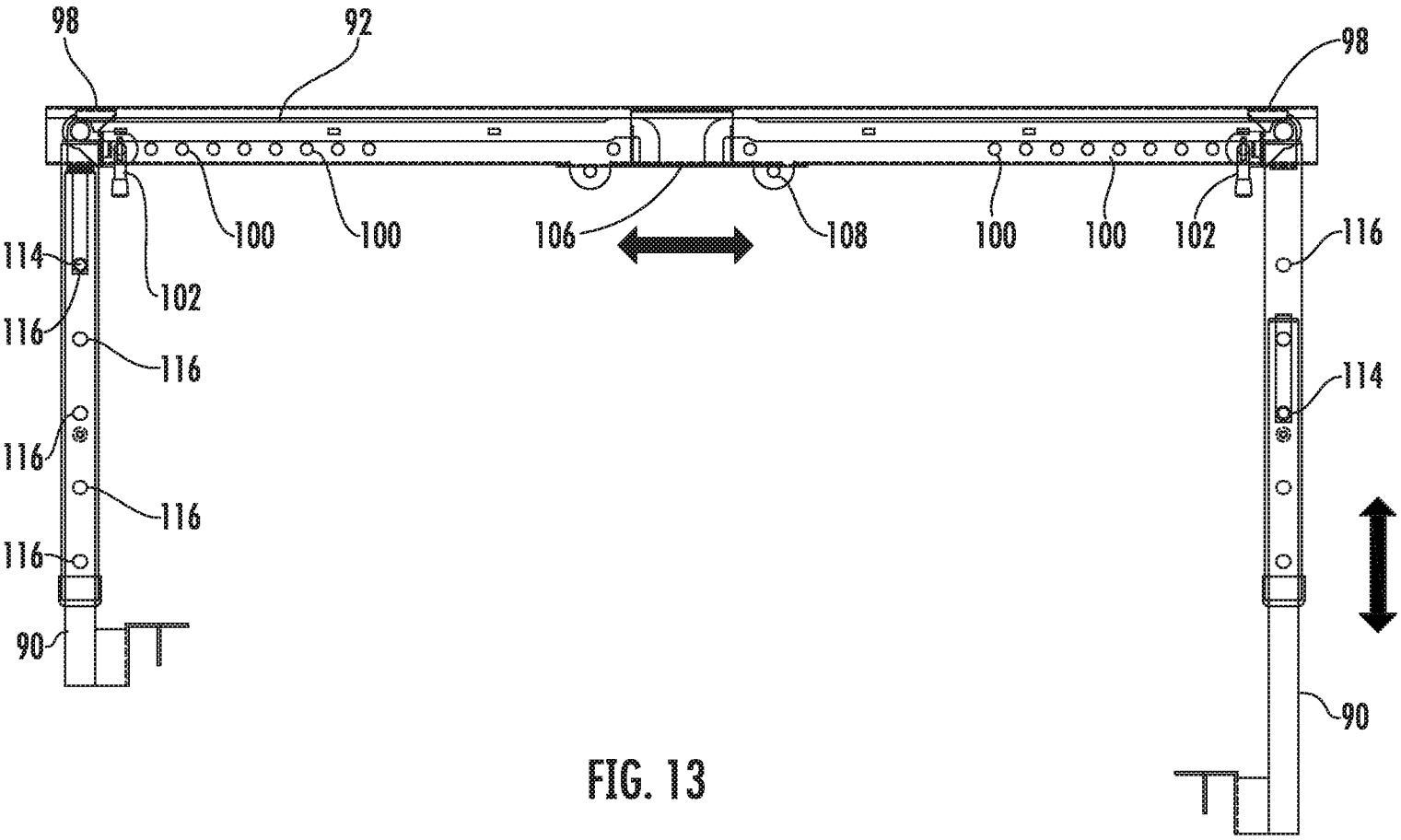
FIG. 13 is a side view of an embodiment of the invention in the operating position.
Figure 14:
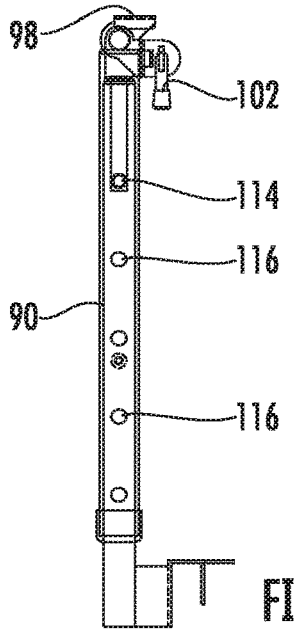
FIG. 14 is a side view of an embodiment of the invention in the stowed position.
Figure 15:
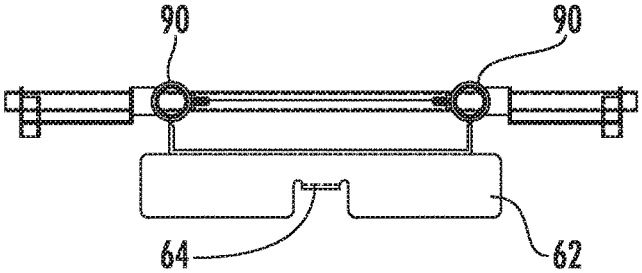
FIG. 15 is a bottom view of an embodiment of the invention described herein.
Figure 16:
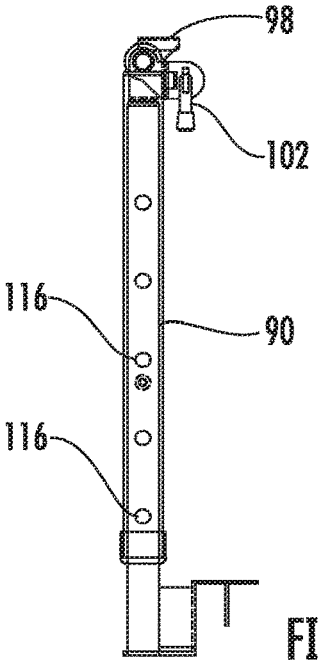
FIG. 16 is a side view of an embodiment of the invention in the stowed position.
Figure 17:
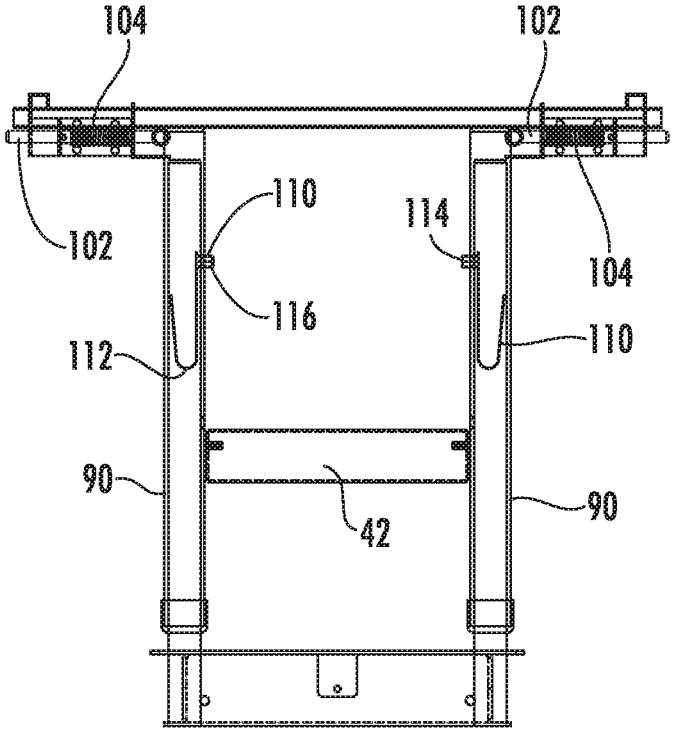
FIG. 17 is a side view of an embodiment of the invention described herein.
Figure 18:
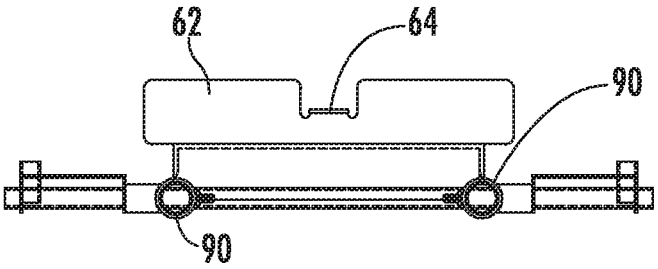
FIG. 18 is a bottom view of an embodiment of the invention described herein.

Referring now to FIGS. 10-18, an embodiment of the invention is shown wherein the size (e.g. the width) of support structure is adjustable to accommodate coolers of different sizes. For example, in an embodiment, the width of the support structure can be adjusted to accommodate coolers from 35 quart size to 125 quart size, or any size in between. In FIG. 13, the width adjustability is indicated by the horizontally oriented arrows that extend perpendicular to the vertical support rails 90. (In contrast, the height adjustability of the vertical support rails 90 is indicated by the vertically oriented arrows in FIG. 13.)

Referring still to FIGS. 10-18, this embodiment includes a pair of guide rails 92. The guide rails 92 can be secured to a work surface (such as a table) by screws 94 (or by other means). Each guide rail 92 forms a channel 96 along the length of the guide rail. A pair of locking pin brackets 98 are slidably engaged with each guide rail 92, such that the locking pin brackets 98 can slide along the length of the guide rail 92 by traveling within the channel 96. The guide rails 92 also include a series of locking pin holes 100, configured to receive a locking pin 102.

The locking pin brackets 98 each house a locking pin 102. The locking pin 102 is slidably engaged with the locking pin bracket 98 such that the locking pin 102 can slide within the locking pin bracket 98 (with the direction of the sliding motion of the locking pin 102 being perpendicular to the direction of the sliding motion of the locking pin bracket 98 within the channel 96). The locking pin bracket 98 also includes a spring 104, which biases the locking pin 102 into a locked (i.e. engaged) position (described in more detail below).

Removable covers 106 can be removably attached to each guide rail 92. When attached to the guide rail 92, the removable cover 106 forms a portion of the walls of the channel 96, and thus can assist in keeping the locking pin bracket 98 contained within the channel 96 as the locking pin bracket 98 slides along the length of the channel 96. The removable cover 106 also includes a dock hole 108, which is configured to receive the locking pin 102.

Figure 10:
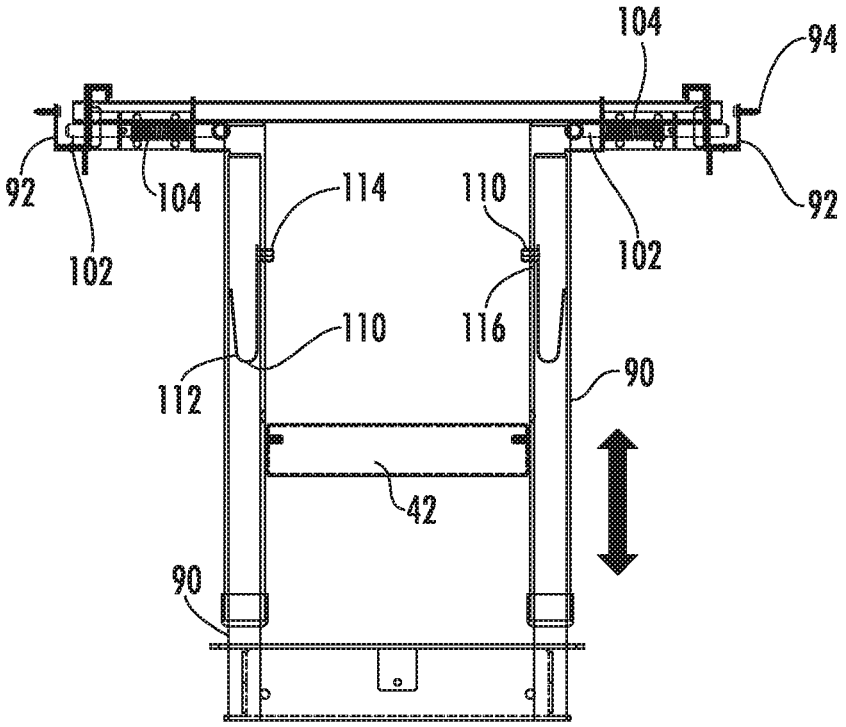
FIG. 10 is a side view of an embodiment of the invention in the operating position.
Figure 11:
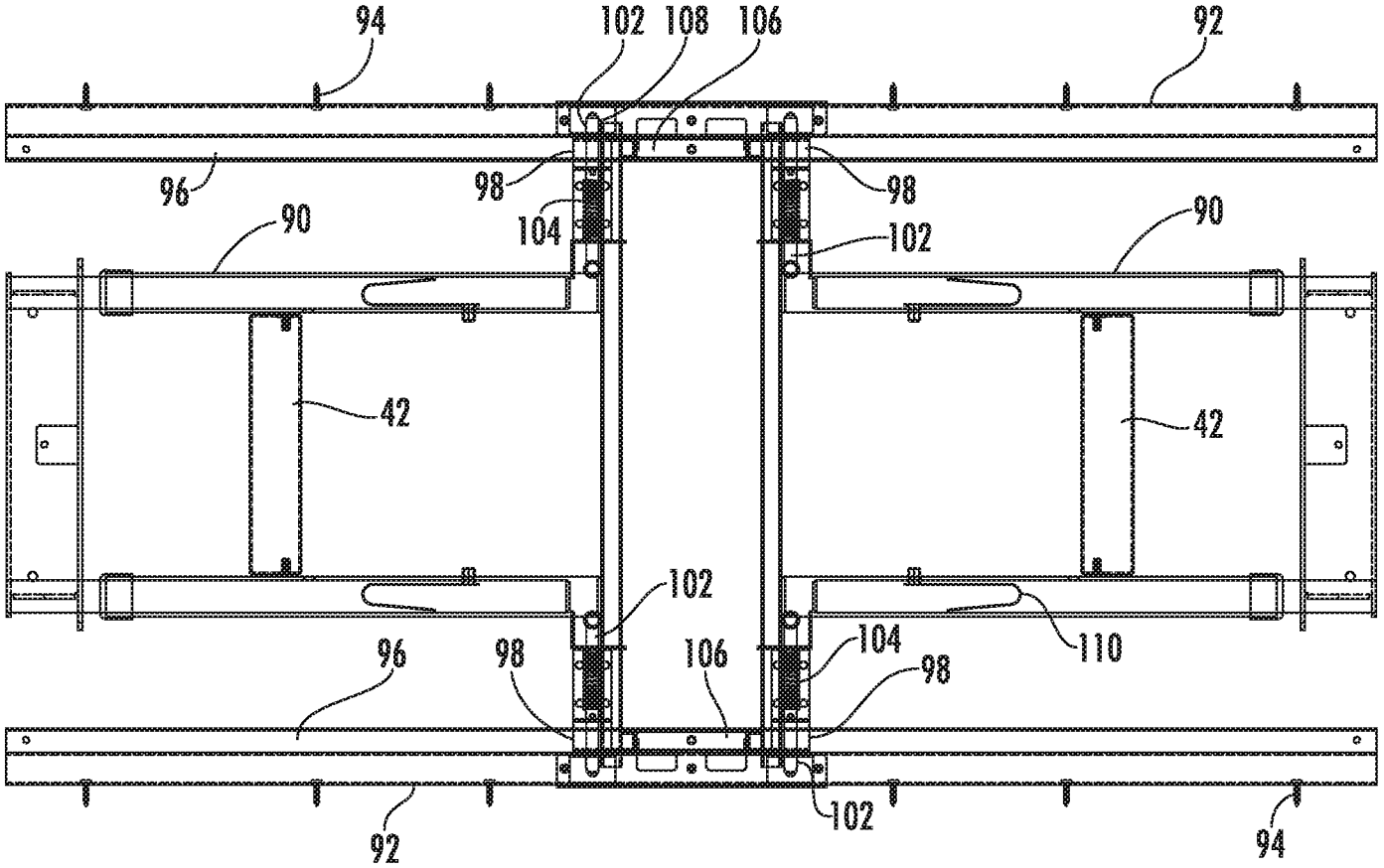
FIG. 11 is a bottom view of an embodiment of the invention in the stowed position.

In the embodiments shown in FIGS. 10-18, vertical support rails 90 are telescoping rails (with an inner tubular member telescoping within an outer tubular member). The telescoping arrangement of the vertical support rails 90 allows the height of the work surface above the cooler to be adjusted. A spring button 110 is engaged with each vertical support rail 90. The spring button 110 includes a spring portion 112 and a button portion 114. The vertical support rails 90 include a series of button holes 116, which are configured to receive the button portion 114 of the spring button 110. The spring portion 112 of the spring button 110 biases the button portion 114 towards the outer surface of the vertical support rail 90, such that when the button portion 114 is aligned with one of the button holes 116 the button portion 114 will be extended out through the button hole 116 (as shown in FIG. 10). When the button portion 114 is extended through a button hole 116 in this manner, the inner tubular member and the outer tubular member of the vertical support rail 90 can no longer telescope relative to each other, thus locking the work surface at a given height above the cooler.

In operation of the embodiments depicted in FIGS. 10 to 18, the support structure is secured to a work surface, such as a table, by screws 94. Often the support structure starts in a stowed position (as showed in FIG. 11), such as when the support structure is not connected to a cooler and as is being stored. In the stowed position, the locking pin brackets 98 are slid to the inner most position along the guide rail 92, the locking pin 102 is engaged with the dock hole 108, and the telescoping tubular members of the vertical support rails 90 are telescoped to their most collapsed (i.e. shortest) position. The vertical support rails 90 are also rotated 90 degrees (relative to the orientation of the vertical support rails 90 depicted in FIG. 13) and folded flat against the bottom side of the work surface such that the vertical support rails 90 are parallel with the work surface (not shown in FIG. 11).

To convert the support structure from the stowed position to the operating position (the operating position is depicted in FIGS. 12 and 13) and attached the support structure to a cooler, a user pulls locking pins 102 in order to disengage the locking pins 102 from the dock hole 108. The user then rotates the vertical support rails 90 degrees from the orientation depicted in FIG. 11 to the orientation depicted in FIG. 12. Next, the user slides the locking pin brackets 98 outward along the guide rails 92 until the desired width of the support structure is reached (with the desired width the support structure corresponding to the size of the cooler). If at this point the locking pins 102 are not already aligned with one of the locking pin holes 100, the user slides the locking pin brackets 98 further along the guide rails 92 until the locking pins 102 are aligned with the nearest corresponding locking pin holes 100. The user then moves the locking pins 102 into the corresponding locking pin holes 100, thereby engaging the locking pins 102 with the corresponding locking pin holes 100. This locks the width of the support structure at the selected width.

A user can also adjust the telescoping vertical support rails 90 so that the work surface is at a desired height above the cooler. This is done by the user depressing the button portion 114 of the spring button 110, and elongating the vertical support rails 90 by sliding the inner tubular member of the vertical support rail 90 relative to the outer tubular member of the vertical support rail 90. Once an approximate desired height of the work surface is reached, the spring button 110 is aligned with and then engaged with the nearest spring button hole 116, which locks the height of the work surface at the desired position.

A user attaches the support structure to the cooler by first placing the support structure over the cooler. The user then lowers the support structure so that the tab 64 fits into the cooler tie down slot 66 and the horizontal support member 62 rests on the top of the outer edge of the top of the cooler (it is noted that in some embodiments, when the horizontal support member 62 rests on the top of the outer edge of the top of the cooler in this manner, the lid of the cooler can close—with the lid effectively resting on top of the horizontal support member 62—without the horizontal support member 62 interfering with the gasket and/or sealing function of the lid). At this point, the support structure and work surface are in the operating position and are ready for use. If desired, the user can move the support mechanism from the operating position to the stowed position by reversing the steps described above.

In some embodiments and/or in some situations, the order of the above described steps can be varied. For example, when moving the support structure from a stowed position to an operating position where the support structure is attached to a cooler, the step of adjusting the height of the vertical support rails 90 can be performed either before or after the step of attaching the support structure to the cooler.

The foregoing description and accompanying drawings illustrate the principles, exemplary embodiments, and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention.

We claim:

1. A cooler-mounted utility table comprising:

a. A work surface;

b. A vertical support member;

c. At least one work surface support rail connected to the work surface and pivotally connected to the vertical support member so that the work surface may pivot from a horizontal position for use and a vertical position for storage and transport;

d. An insulated cooler, the insulated cooler having a lid and at least one cooler tie-down slot; and e. A mounting bracket connected to the vertical support member, the mounting bracket having a vertical tab fitted securely into the cooler tie-down slot, the mounting bracket further having a mounting bracket vertical support member and a mounting bracket horizontal support member, the mounting bracket horizontal support member extending horizontally out from the mounting bracket vertical support member, such that the mounting bracket horizontal support member rests on the cooler and supports the weight of the utility table, and such that the lid of the cooler is capable of closing and resting on the top of the mounting bracket horizontal support member.

2. The table of claim 1, further comprising a pair of work surface support rails connected to the work surface near opposite edges of the work surface.

3. The table of claim 1, wherein the pivotal connection comprises a pivoting member connected at one end to the vertical support member and at the other end to a slot in the work surface support rail.

4. The table of claim 3, further comprising a latch configured to hold the pivoting member in a selected position when the work surface is in the use position, such that the latch can be operated to release the work surface so that it may pivot from a horizontal position to a vertical position for storage and transport.

5. The table of claim 1 wherein the vertical support member further comprises a pair of vertical rails and a support crosspiece that extends between the vertical rails and is connected to each vertical rail.

6. The table of claim 1 wherein the mounting bracket comprises an upper receiver and a lower support, such that the vertical support member is positioned through the upper receiver and rests on the lower support when the table is installed on a cooler.

7. The table of claim 1 wherein the vertical support member comprises a pair of rails made of metal tubing.

8. The table of claim 1 further comprising a pair of vertical support members connected to opposite ends of the work surface and a pair of mounting brackets connected to opposite sides of the cooler.

9. The table of claim 1 wherein the vertical support member comprises at least one telescoping vertical rail.

10. A cooler-mounted utility table comprising:

a. A work surface;

b. A pair of work surface support rails connected to the work surface near opposite edges of the work surface;

c. A pair of upper, vertical support rails pivotally connected to the work surface support rails;

d. A pair of primary vertical support rails configured to receive the pair of upper, vertical support rails;

e. An insulated cooler, the insulated cooler having a lid and at least one cooler tie-down slot; and f. A mounting bracket connected to at least one of the primary vertical support rails, the mounting bracket having a vertical tab fitted securely into the cooler tie-down slot, the mounting bracket further having a mounting bracket vertical support member and a mounting bracket horizontal support member, the mounting bracket horizontal support member extending horizontally out from the mounting bracket vertical support member, such that the mounting bracket horizontal support member rests on the cooler and supports the weight of the utility table, and such that the lid of the cooler is capable of closing and resting on the top of the mounting bracket horizontal support member.

11. The table of claim 10 further comprising a cross support member extending between and connected to each of the primary vertical support rails.

12. The table of claim 10 wherein the insulated cooler further comprises a horizontal surface adjacent to the cooler tie-down slot; and wherein the pair of upper, vertical support rails are configured such that the angle between the pair of upper, vertical support rails and the horizontal surface of the cooler is not 90 degrees.

13. The table of claim 1, further comprising a second vertical support member, wherein the distance between a connection point of the vertical support member to the work surface and a connection point of the second vertical support member to the work surface is adjustable.

14. The table of claim 1 wherein the insulated cooler further comprises a horizontal surface adjacent to the cooler tie-down slot; and wherein the vertical support member is configured such that the angle between the vertical support member and the horizontal surface of the cooler is not 90 degrees.

* * * * *